United States Patent [19]

Newman et al.

[11] 4,019,207

[45] Apr. 26, 1977

[54] SURGICAL GOWN BELTING MEANS

[75] Inventors: John W. Newman, Whitefish Bay, Wis.; Frank D. Schoonover, Douglas, Ariz.

[73] Assignee: Will Ross, Inc., Milwaukee, Wis.

[22] Filed: May 28, 1976

[21] Appl. No.: 691,070

[52] U.S. Cl. ..... 2/51; 2/DIG. 7

[51] Int. Cl.[2] ..... A41D 13/00

[58] Field of Search ..... 2/51, 114, DIG. 7

[56] References Cited

UNITED STATES PATENTS

| | | | |
|---|---|---|---|
| 3,570,012 | 3/1971 | Winters | 2/114 |
| 3,648,290 | 3/1972 | Hartigan | 2/114 |
| 3,696,443 | 10/1972 | Taylor | 2/DIG. 7 |
| 3,721,999 | 3/1973 | Goya et al. | 2/114 |

*Primary Examiner*—Werner H. Schroeder

*Assistant Examiner*—Moshe I. Cohen

*Attorney, Agent, or Firm*—John A. Dhuey

[57] ABSTRACT

An improved gown belting means is described for back-closure gowns, or gowns commonly known as "sterile back" gowns, having one tie attached to the gown at the outer edge of a rear panel with an intermediate segment of the tie retained in a tunnel loop near the inner edge of the rear panel and a portion of the free end of the tie looped in a transfer tab, and a second tie attached to the gown at the inner edge of a second rear panel, having an intermediate segment releasably attached to the gown or held within a loop. The second tie has a free, unattached end retained at or above waist-level by the attached intermediate segment.

6 Claims, 3 Drawing Figures

SURGICAL GOWN BELTING MEANS

The present invention is concerned with belting means for surgical gowns. In particular, it is concerned with belting means for back-closure surgical gowns, the upper, frontal area of which must be maintained in a sterile condition during the gowning procedure. The invention is also concerned with belting means for "sterile back" gowns wherein the upper, frontal and upper back areas of the gown must be maintained in a sterile condition.

Back-closure gowns generally can be considered to have a frontal panel, extending from the neck of a wearer to about mid-calf and between the sleeve openings, and two rear or side panels integral with or joined to the frontal panel at each along its length and being of sufficient width to wrap around the back of a wearer. The donning of such gowns presents a sterility problem since standard practice defines the sterile area as the front portion and back portion of the gown above waist-level. Accordingly, the wearer's hands may not be placed below waist level or behind the gown. Such limitation presents a severe practical problem during the donning procedure.

Usually the surgeon is assisted during the donning procedure by an assistant, who may be considered sterile or non-sterile depending on the particular circumstances. Thus, provisions must be made to provide a gown which can be secured with the assistance of a sterile or non-sterile person without contaminating the defined sterile area of the gown.

Numerous solutions to the above-identified problems have been suggested in the prior art but have not been found to be entirely satisfactory. U.S. Pat. No. 3,935,596 discloses a transfer tab in which the free ends of both ties are retained in the tab prior to the gowning procedure. FIG. 1 of that patent clearly indicates the configuration of the ties and transfer tab. In use, it is suggested that the surgeon grasp the free end of tie C, pulling it from the transfer device, and hand the transfer device to the person assisting. Several problems are immediately apparent.

Firstly, the close proximity of the two tie string ends may result in the surgeon pulling on the wrong tie string. It may be that the surgeon removes tie D from the transfer tab, which then remains attached to tie C. If the assisting person is non-sterile, that person cannot touch tie D and pass it about the back of the surgeon without the use of a sterile instrument (e.g. forceps). The gowning operation may have to be aborted at this point, and a new gown procured.

Secondly, the surgeon may be release tie C from the transfer device without grasping the transfer device. Tie D, along with the transfer device then would fall below waist level into a contaminated area. Again, the gowning procedure would have to be aborted and a new gown precured.

U.S. Pat. No. 3,754,284 presents another attempted solution of the above-identified problems. However, the described system is not entirely satisfactory since the location of the transfer device at the gown back precludes a non-sterile person from assisting the surgeon, if the gown is a "sterile back" gown, or a sterile person if the gown is a back closure gown. Also, the knot is tied in the front of the gown, which location may be uncomfortable for the surgeon and may interfere with surgical procedures.

In order to provide a "sterile back" or a back-closure gown which can be donned with the assistance of a sterile or non-sterile assistant with minimum confusion, an improved belting system has been devised which will be described with reference to the following drawings in which.

Figure 1:
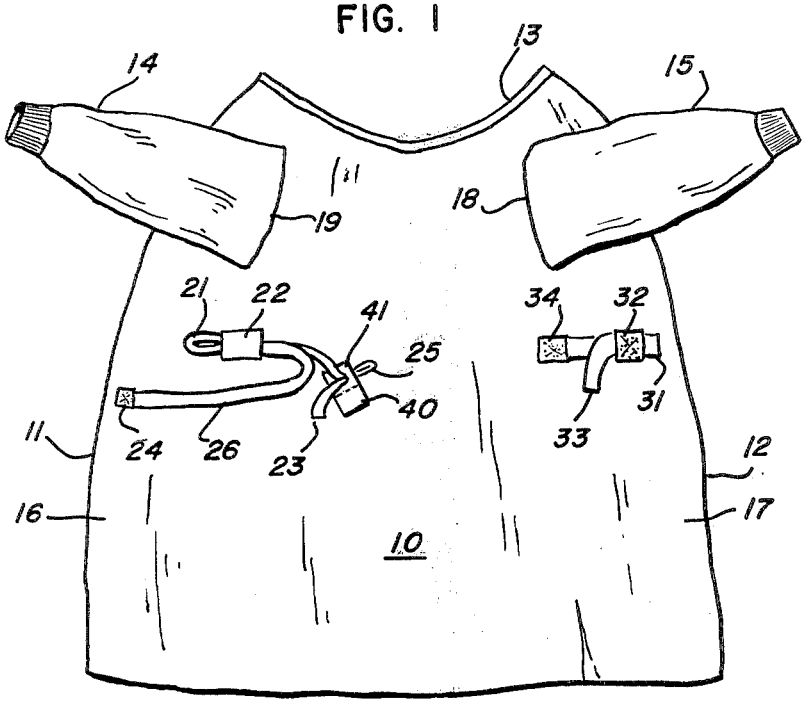
FIG. 1 is a front elevational view of a surgical gown in accordance with the present invention.
Figure 3:
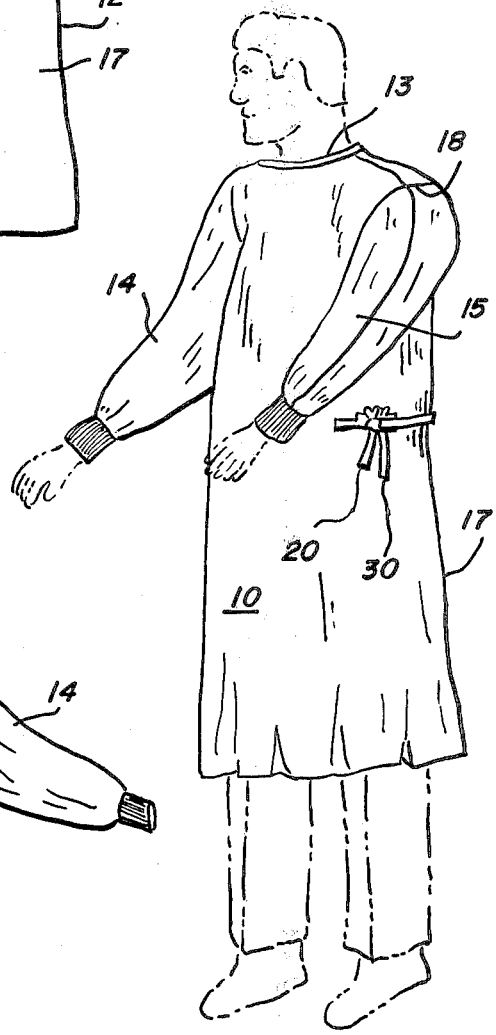
FIG. 3 is a front perspective view of the gown on a surgeon.
Figure 2:
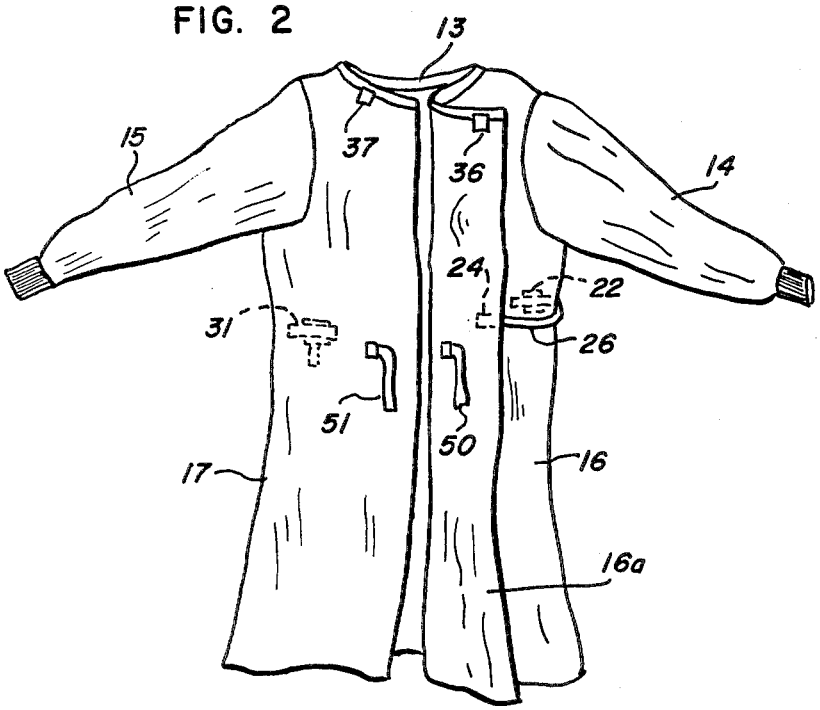
FIG. 2 is a rear elevational view of such a surgical gown.

The gown consists of a front panel 10 having rear or side panels 16 and 17 integrally jointed therewith. In practice, the gown may be formed from one or more pieces of non-woven paper or textile material, which said disposable after use. The rear or side panels are designated separately for ease in description only, particularly with regard to the location of the belting means hereinafter described. Panels 16 and 17 may be alternately described as rear or side panels in that they extend from the side of front panel 10 but are adapted to surround the back of a wearer and comprise rear panels when the gowning procedure has been completed. In a "sterile back" gown, portion **16*a* of panel 16 will be folded back onto panel 16 prior to the gowning procedure. Then when panel 16 is wrapped about the back of the surgeon, the upper, outwardly exposed area of panel 16** will be considered to be in a sterile state.

Absent the belting means of this invention, the gown is largely conventional as described above. Panels 16 and 17 have outwardly facing edges 11 and 12, respectively. Sleeves 14 and 15 are attached to the gown in a conventional manner and a neck portion 13 is provided with cooperating closure means 36 and 37. Typically, closure means 36 and 37 comprise VELCRO fasteners or a multitude of snaps to adjusts for variations in the neck size of a wearer. Sleeves 14 and 15 form frontal seams 18 and 19 in connection with front panel 10. An inner belting means 50 and 51 is provided and comprises tie 50 on the inside of panel 16, i.e. portion **16*a* of panel 16, and tie 51 attached to the outside of panel 17 near its outer edge 12**.

The improved belting system of this invention comprises two ties 20 and 30 arranged on the gown in a configuration which eliminates confusion that might arise during the gowning procedure and which provides a system to maintain the sterile area of the gown free from contamination. Tie 20 is attached at one end 24 to rear panel 16 near its outer edge 11, at or above waist level. Tie 20 has an intermediate portion 26, which extends toward front panel 10 and has a folded portion 21 retained in a tunnel loop 22 attached above waist level at approximately the juncture of panels 16 and 10. Folded portion 21 enters tunnel loop 22 from the side facing front panel 10. Tie 20 has a free end 23 extending out of tunnel loop 22 and having a looped portion 25 retained in a transfer tab 40. Loop portion 25 conveniently is retained in a slit 41 on tab 40. Various shapes for slit 41 may be employed, such as a cross-cut slit, a T-shaped slit or S-shaped loop. The location of tunnel loop 22 and the length of the folded, intermediate portion 21 of tie 20 are adjusted to prevent free end 23 from extending below waist level.

Tie 30 is attached at end 34 at a point at or slightly above waist level at the juncture of panels 10 and 17. An intermediate segment 31 of tie 30 is folded upon itself and releasably held in a tunnel loop 32. Alternatively, but less preferably, intermediate segment 31 can be releasably attached at its lower surface to panel 17 and to itself between folds by conventional adhesives which release upon application of a pulling force. Free end 33 of tie 30 is retained above waist level by the proper location of tunnel loop 32.

The surgical gown is folded in a conventional manner such that the arm-holes for sleeves 14 and 15 are available for insertion of the surgeons arms and such that front panel 10 is protected from contamination. For a "sterile back" gown, portion 16(a) of panel 16 is folded onto panel 16 to preserve the sterile condition of the upper, back portion of panel 16. The surgeon inserts his arms in sleeves 14 and 15, not allowing his hands to drop below waist level, and the gown is allowed to unfold downwardly along his body. The assistant then fastens closure means 36 and 37 about the neck of the surgeon and knots back ties 50 and 51, all in the usual manner. It is apparent that the assistant has not contacted the sterile frontal area of the gown.

At this point, the surgeon grasps transfer tab 40, which may be color-coded so that the surgeon is directed to grasp only a certain portion of the tab, and with an outward motion pulls tie 20 from tunnel loop 22. Tie 20 will not drop below waist level as long as the surgeon maintains his hands above waist level. The transfer tab 40 is then handed to the assistant, who passes around the back of the surgeon pulling panel 16 tightly about the body. Since panels 16 and 17 have been fastened already by means of ties 50 and 51, this operation is largely to remove any excess material from the frontal area of the gown. As the assistant is passing tie 20 about the back of the surgeon, the surgeon grasps free end 33 of tie 30 pulling outwardly to release the tie fron tunnel loop 32.

When the closure of panel 16 about the surgeon is complete, the assistant, who is holding tab 40, presents the free end 23 of tie 20 to the surgeon. The surgeon grasps free end 23 and pulls the looped portion 25 of tie 20 from the slit 41 of tab 40, which is retained by the assistant. The surgeon then proceeds to tie ends 23 and 33 and draw the gown tightly about the waist. Accordingly, the gowning procedure is completed in an extremely facile manner while minimizing the danger of contamination of the frontal area of the gown.

It is apparent from the above description, that the deficiencies inherent in the prior art systems are largely eliminated. Since only one tie is attached to the transfer tab, the surgeon should not be confused as to what to grasp. Additionally, the transfer tab is located in the front, sterile area of the gown so that it can be first grasped by the surgeon and then touches by either a sterile or non-sterile assistant. The knot formed by the tie strings is off to the side of the surgeon where it will not interfere with surgical procedures.

The invention has been described with reference to the following drawings. However, they are not meant to limit the invention either in spirit or scope as many variations will be apparent to those skilled in the art without departing from the invention.

What is claimed is:

1. A belting system for use on a back-closure surgical gown having a front panel and two rear panels integral therewith which comprises:

a first tie having a first end, a second end and an intermediate segment between said first and second ends, said first of said rear panels at about waist level;

a belt transfer means releasably attached to the second end of said first tie;

a belt retention means adapted to be affixed to said gown at or above waist level and proximate to a juncture of the first of said rear panels and said front panel, said retention means releasably retaining the intermediate segment of said first tie at a fixed position with respect to said gown; and a second tie having a first end, a second end and an intermediate segment between said first and second ends, said first end adapted to be affixed to said gown at or above waist level proximate to a juncture of the second of said rear panels and said front panel, and said intermediate segment adapted to be releasably retained on said gown so as to retain said second end of said second tie at or above waist level.

2. A belting system as in claim 1 wherein said belt retention means is a loop adapted to receive the intermediate segment of said first tie in a folded configuration.

3. A belting system as in claim 2 wherein said transfer means is a substantially rectangular tab having a T-shaped slit near one end thereof for releasable attachment to said first tie.

4. A belting system as in claim 3 wherein said tab has contrasting colors on the end attached to said belt means and the end unattached to said belt means.

5. A belting system as in claim 2 wherein said transfer means is a substantially rectangular tab having a single hook-shaped slit disposed near one end thereof for releasable attachment to said first tie.

6. A belting system as in claim 1 wherein said intermediate segment of said second tie is retained in a tunnel loop.

* * * * *

UNITED STATES PATENT AND TRADEMARK OFFICE

CERTIFICATE OF CORRECTION

PATENT NO. : 4,019,207

DATED : Apr. 26, 1977

INVENTOR(S) : John W. Newman & Frank D. Schoonover

It is certified that error appears in the above-identified patent and that said Letters Patent are hereby corrected as shown below:

Column 1, line 16, "each along" should read -- each edge along--.

Column 1, line 58, "precured" should read -- procured --.

Column 2, line 17, "said" should read -- is --.

Column 3, line 36, "fron" should read -- from --.

Column 4, line 15, "ends, said first of" should read -- ends, said first end adapted to be affixed to said gown at the outer edge of a first of --.

Signed and Sealed this

*second* Day of *August 1977*

[SEAL]

*Attest:*

RUTH C. MASON
*Attesting Officer*

C. MARSHALL DANN
*Commissioner of Patents and Trademarks*